US010624462B2

(12) United States Patent
Tavares

(10) Patent No.: US 10,624,462 B2
(45) Date of Patent: Apr. 21, 2020

(54) ADJUSTABLE BED FRAME RAIL RISER ASSEMBLIES

(71) Applicant: Antonio S. Tavares, Haverhill, MA (US)

(72) Inventor: Antonio S. Tavares, Haverhill, MA (US)

( * ) Notice: Subject to any disclaimer, the term of this patent is extended or adjusted under 35 U.S.C. 154(b) by 224 days.

(21) Appl. No.: 15/970,785

(22) Filed: May 3, 2018

(65) Prior Publication Data

US 2019/0008282 A1 Jan. 10, 2019

Related U.S. Application Data

(62) Division of application No. 15/642,012, filed on Jul. 5, 2017, now Pat. No. 9,993,089.

(51) Int. Cl.
*A47C 19/04* (2006.01)
*A47C 19/02* (2006.01)

(52) U.S. Cl.
CPC ..... *A47C 19/045* (2013.01); *A47C 19/025* (2013.01)

(58) Field of Classification Search
CPC ..... A47C 19/005; A47C 19/02; A47C 19/021; A47C 19/025; A47C 19/04; A47C 19/045
See application file for complete search history.

(56) References Cited

U.S. PATENT DOCUMENTS 2,018,529 A * 10/1935 Parrish ..... A47C 19/045 5/209
2,845,636 A * 8/1958 Iaquinta ..... F16B 12/60 5/132
3,336,606 A * 8/1967 Beitzel ..... A61G 7/002 5/610
3,748,668 A * 7/1973 Rudin ..... A47C 19/022 5/296
3,821,821 A * 7/1974 Burst ..... A61G 7/002 5/616
4,715,073 A * 12/1987 Butler ..... A61G 7/005 5/509.1
4,856,129 A * 8/1989 Butler ..... A47C 19/045 5/610
5,203,039 A * 4/1993 Fredman ..... A47C 19/024 248/188.4
5,205,005 A * 4/1993 Merrill ..... A47C 19/045 5/400
5,243,726 A * 9/1993 Bisbee ..... A61G 7/005 5/509.1

(Continued)

*Primary Examiner* — Eric J Kurilla
(74) *Attorney, Agent, or Firm* — North Shore Patents, P.C.; Michele Liu Baillie

(57) ABSTRACT

Adjustable bed frame rail riser assemblies include a first riser assembly that detachably couples to a first rail of a bed frame and a second riser assembly that detachably couples to a second rail of the bed frame. Each riser assembly includes a wedge with a top surface with a slope that inclines or declines a mattress or box spring that resides on the top surface. The riser assemblies may be detachably coupled to standard metal or wooden bed frames and need not be permanent fixtures of the bed frames. The riser assemblies of the present invention do not require levers, arms, or electrical parts. The riser assemblies can further be coupled to standard metal or wooden bed frames, without requiring specially designed beds or bed frames.

4 Claims, 7 Drawing Sheets

(56) References Cited

U.S. PATENT DOCUMENTS 5,815,860 A * 10/1998 Mitchell ..... A47C 19/024 5/236.1
5,894,614 A * 4/1999 Stroud ..... A47B 91/028 5/200.1
6,006,382 A * 12/1999 Smith ..... A47C 19/045 5/310
6,138,305 A * 10/2000 Smith ..... A47C 19/024 5/310
6,216,289 B1 * 4/2001 Woods ..... A47B 91/028 5/200.1
6,276,011 B1 * 8/2001 Antinori ..... A47C 20/041 5/613
6,301,732 B1 * 10/2001 Smith ..... A47C 19/024 5/660
6,516,478 B2 * 2/2003 Cook ..... A47C 19/045 108/147
6,772,462 B1 * 8/2004 Harrell ..... A47C 19/045 5/659
6,957,456 B2 * 10/2005 Darling ..... A47C 19/045 5/509.1
7,240,385 B1 * 7/2007 Brown ..... A47C 20/022 5/617
7,690,058 B1 * 4/2010 Dwyer ..... A47C 19/005 5/200.1
8,484,775 B2 * 7/2013 Littlefield ..... A47D 7/03 5/11
9,993,089 B1 * 6/2018 Tavares ..... A47C 19/025
2005/0278848 A1 * 12/2005 Polevoy ..... A47C 19/005 5/201
2008/0256704 A1 * 10/2008 Conway ..... A47C 19/045 5/412
2009/0113627 A1 * 5/2009 Harrow ..... A47C 19/005 5/200.1
2011/0173751 A1 * 7/2011 Beaton ..... A47C 19/045 5/509.1
2011/0209284 A1 * 9/2011 Dane ..... A61G 5/12 5/81.1 C
2013/0019407 A1 * 1/2013 Sheppard ..... A47C 20/041 5/611
2015/0250324 A1 * 9/2015 Amann-Jennson .... A61G 7/005 5/412
2016/0206094 A1 * 7/2016 Fisher, III ..... A47B 91/024
2017/0166104 A1 * 6/2017 Gilmore ..... B60P 3/39

* cited by examiner

ADJUSTABLE BED FRAME RAIL RISER ASSEMBLIES

BACKGROUND OF THE INVENTION

The ability to incline a bed mattress, either at the head or the foot, may be desirable to address a variety of ailments, including back pain, neck pain, and circulation issues. Beds that incline exist in the market, however, these solutions require the addition of levers, arms, or other mechanical parts, require electrical parts, or require specially designed beds and/or bed frames that are costly.

BRIEF SUMMARY OF THE INVENTION

Disclosed herein is adjustable bed frame rail riser assemblies as specified in the independent claims. Embodiments of the present invention are given in the dependent claims. Embodiments of the present invention can be freely combined with each other if they are not mutually exclusive.

According to first embodiment of the present invention, bed frame rail riser assemblies include a first riser assembly and a second riser assembly. The first riser assembly of the first embodiment includes: a first wedge with a first top surface, a first bottom surface opposite the first top surface, a first side of the first wedge, a second side of the first wedge opposite the first side of the first wedge, a first tall end, and a first short end, where the first tall end and the first short end create a first slope at the first top surface of the first wedge; and one or more first brackets coupled to the first side of the first wedge.

According to the first embodiment, each first bracket includes: a first plate; and a first tongue, including a first portion of the first tongue that is thicker than a remainder of the first tongue and is located proximate to an end of the first tongue. The first tongue is coupled to the first plate at the first portion, where a first gap exists between the first plate and the remainder of the first tongue. When the first riser assembly is detachably coupled to a first rail of a bed frame, a first vertical wall of the first rail resides within the first gap.

The second riser assembly of the first embodiment includes: a second wedge with a second top surface, a second bottom surface opposite the second top surface, a first side of the second wedge, a second side of the second wedge opposite the first side of the second wedge, a second tall end, and a second short end, where the second tall end and the second short end create a second slope at the second top surface the second wedge; and one or more second brackets coupled to the second side of the second wedge.

According to the first embodiment, each second bracket includes: a second plate; and a second tongue, including a first portion of the second tongue that is thicker than a remainder of the second tongue and is located proximate to an end of the second tongue. The second tongue is coupled to the second plate at the first portion of the second tongue, where a second gap exists between the second plate and the remainder of the second tongue. When the second riser assembly is detachably coupled to a second rail of the bed fame, a second vertical wall of the second rail resides within the second gap.

According to second embodiment of the present invention, the first riser assembly includes: a first wedge with a first top surface, a first bottom surface opposite the first top surface, a first side of the first wedge, a second side of the first wedge opposite the first side of the first wedge, a first tall end, and a first short end, wherein the first tall end and the first short end create a first slope at the first top surface of the first wedge; one or more first brackets coupled to the first side of the first wedge; and one or more first plates.

According to the second embodiment, each first bracket includes: a first coupling portion of the first bracket; a second coupling portion of the first bracket; and a pocket portion of the first bracket between the first coupling portion and the second coupling portion of the first bracket, where a first pocket exists between the pocket portion of the first bracket and the first wedge. Each first plate includes: a first tongue portion of the first plate; a first coupling portion of the first plate; and a first bend between the first tongue portion and the first coupling portion of the first plate. When installed on a first rail of a bed frame, the first coupling portion of the first plate is coupled to a first vertical wall of the first bed rail such that the first tongue portion of the first plate bends away from the first vertical wall. When the first riser assembly is detachably coupled to the first rail of the bed frame, the first tongue of the first plate resides within the pocket portion of the first bracket.

According to the second embodiment, the second riser assembly includes: a second wedge with a second top surface, a second bottom surface opposite the second top surface, a first side of the second wedge, a second side of the second wedge opposite the first side of the second wedge, a second tall end, and a second short end, wherein the second tall end and the second short end create a second slope at the second top surface of the second wedge; one or more second brackets coupled to the second side of the second wedge; and one or more second plates.

According to the second embodiment, each second bracket includes: a first coupling portion of the second bracket; a second coupling portion of the second bracket; and a pocket portion of the second bracket between the first coupling portion and the second coupling portion of the second bracket, wherein a second pocket exists between the pocket portion of the second bracket and the second wedge. Each second plate includes: a second tongue portion of the second plate; a second coupling portion of the second plate; and a second bend between the second tongue portion and the second coupling portion of the second plate. When installed on a second rail of the bed frame, the second coupling portion of the second plate is coupled to a second vertical wall of the second bed rail such that the second tongue portion of the second plate bends away from the second vertical wall. When the second riser assembly is detachably coupled to the second rail of the bed frame, the second tongue of the second plate resides within the pocket portion of the second bracket.

In one aspect of the present invention, the first riser assembly further includes one more first adjustable feet coupled to the first bottom surface of the first wedge, where a length of each first adjustable feet protruding beyond the first bottom surface of the first wedge is independently adjustable to affect an angle of the first slope at the first top surface of the first wedge. The second riser assembly further includes one or more second adjustable feet coupled to the second bottom surface of the second wedge, where a length of each second adjustable feet protruding beyond the second bottom surface of the second wedge is independently adjustable to affect an angle of the second slope at the second top surface of the second wedge.

In one aspect of the present invention, when the first riser assembly is detachably coupled to the first rail of the bed frame, the one or more first adjustable feet rests on a first horizontal wall of the first rail. When the second riser assembly is detachably coupled to the second rail of the bed frame, the one or more second adjustable feet rests on a second horizontal wall of the second rail.

DETAILED DESCRIPTION OF THE INVENTION

The following description is presented to enable one of ordinary skill in the art to make and use the present invention and is provided in the context of a patent application its requirements. Various modifications to the embodiment will be readily apparent to those skilled in the art and the generic principles herein may be applied to other embodiments. Thus, the present invention is not intended to be limited to the embodiment shown but is to be accorded the widest scope consistent with the principles and features described herein.

Reference in this specification to "one embodiment", "an embodiment", "an exemplary embodiment", or "a preferred embodiment" means that a particular feature, structure, or characteristic described in connection with the embodiment is included in at least one embodiment of the invention. The appearance "embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments. In general, features described in one embodiment might be suitable for use in other embodiments as would be apparent to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, elements, and/or components, but do not preclude the presence or addition of one or more other features, elements, components, and/or groups thereof.

Figure 1:
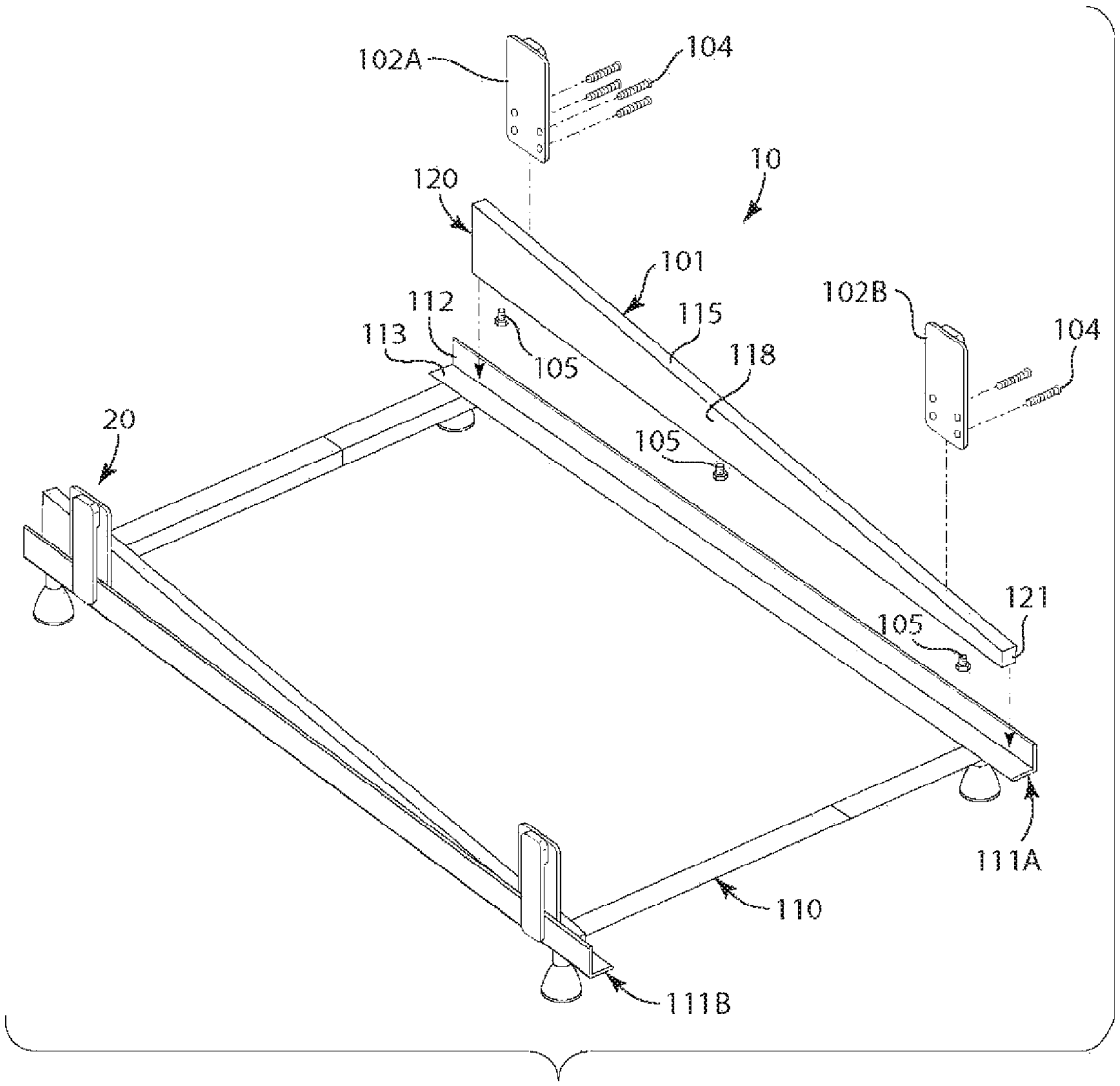
FIG. 1 illustrates a perspective view of the first embodiment of adjustable bed frame rail riser assemblies according to the present invention, as detachably coupled to a standard metal bed frame.
Figure 2:
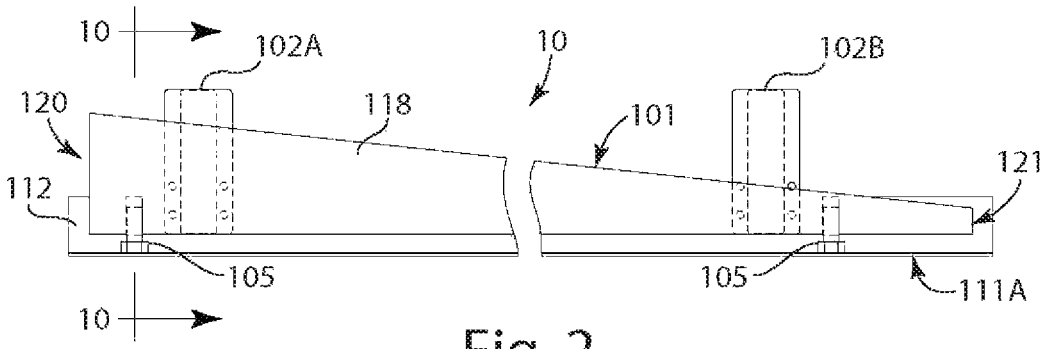
FIGS. 2-5 illustrate front, back, bottom, and top views, respectively, of the first assembly, as detachably coupled to a first metal rail, according to the first embodiment of the present invention.
Figure 3:
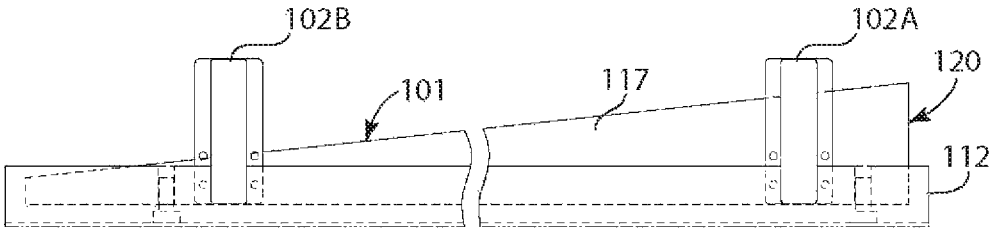
Figure 4:
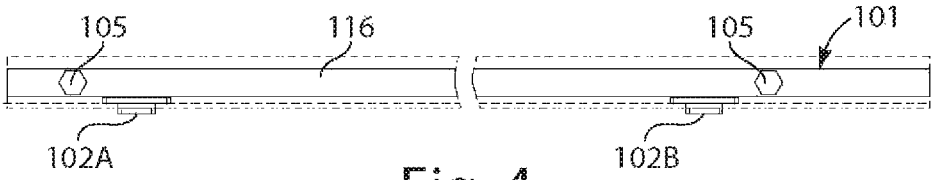
Figure 5:
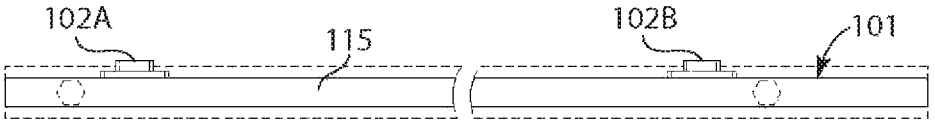
Figure 6:
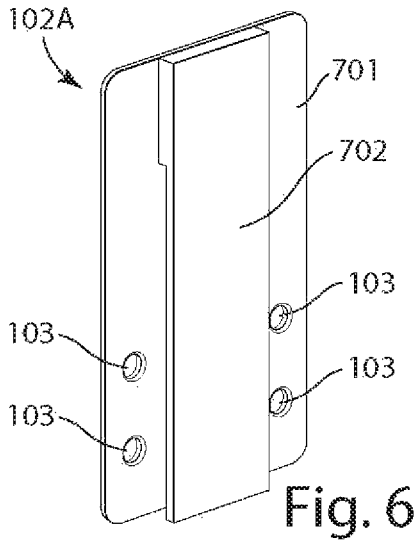
FIGS. 6-9 illustrate perspective, front, back, and side views, respectively, of a bracket of the first riser assembly according to the first embodiment of the present invention.
Figure 7:
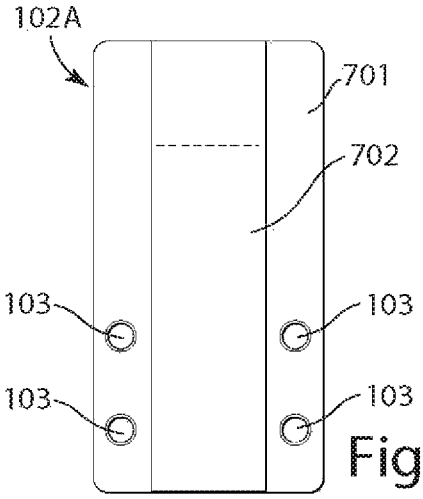
Figure 8:
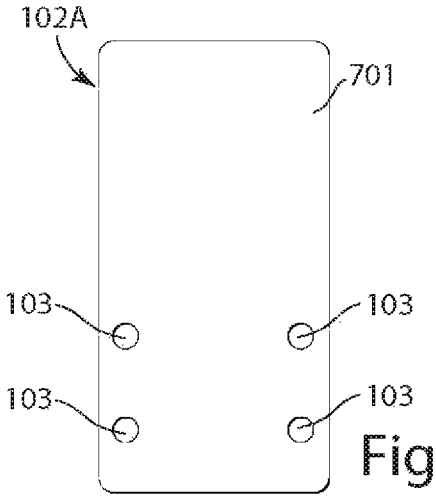

FIGS. 1-10 illustrate a first embodiment of adjustable bed frame rail riser assemblies according to the present invention. FIG. 1 illustrates a perspective view of the first embodiment of adjustable bed frame rail riser assemblies according to the present invention, as detachably coupled to a standard metal bed frame. The first embodiment comprises a first riser assembly 10 that can be detachably coupled to a first metal rail 111A of the metal bed frame 110 and a second riser assembly 20 that can be detachably coupled to a second metal rail 111B of the metal bed frame 110. The metal bed frame 110 is shown for illustrative purposes only and is not to be construed as part of the embodiments of the present invention. FIGS. 2-5 illustrate front, back, bottom, and top views, respectively, of the first riser assembly 10, as detachably coupled to the first metal rail 111A, according to the first embodiment of the present invention.

Referring to FIGS. 1-5, the first riser assembly 10 comprises a wedge 101 with a top surface 115 and a bottom surface 116 opposite the top surface 115, a first side 117 and a second side 118 opposite the first side 117, one or more brackets 102A-102B coupled to the first side 117 of the wedge 101, one or more screws 104, and one or more adjustable feet 105 coupled to the bottom surface 116 of the wedge 101. The wedge 101 comprises a tall end 120 and a short end 121, creating a slope at the top surface 115 of the wedge 101. When detachably coupled to the first metal rail 111A, the one or more brackets 102A-102B detachably couple to a vertical wall 112 of the first metal rail 111A, and the adjustable feet 105 rest on a horizontal wall 113 of the first metal rail 111A. The positions and number of the brackets 102A-102B may be selected as a design choice, such as to accomplish the desired stability of the first riser assembly 10 when installed. In this exemplary embodiment, the brackets 102A-102B are coupled to the wedge 101 using one or more screws 104 traversing through one or more holes 103 in the brackets 102A-102B (see FIGS. 6-9), however, other coupling mechanisms may be used. In this exemplary embodiment, one or more screws are used as the adjustable feet 105, where the length of each screw that protrudes beyond the bottom surface 116 of the wedge 101 may be independently adjusted to affect the angle of the slope at the top surface 115 of the wedge 101. Mechanisms other than screws may be used as well. The second riser assembly 20 comprises same construction as the first riser assembly 10, except the brackets 102A-102B are coupled to the second side 118 of the wedge 101.

With the first and second riser assemblies 10, 20 detachably coupled to the first and second metal rails 111A-111B, a mattress or box spring may be placed on the top surfaces 115 of the wedges 101. The slopes at the top surfaces 115 of the wedges 101 cause the mattress or box spring to rest at an incline or decline, with the tall ends 120 positioned at the head or feet of a user.

Figure 9:
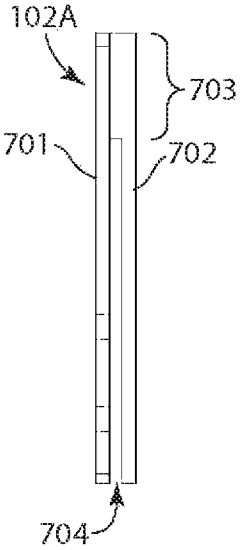

FIGS. 6-9 illustrate perspective, front, back, and side views, respectively, of the bracket 102A of the first riser assembly 10 according to the first embodiment of the present invention. The bracket 102A comprises a plate 701 and a tongue 702 comprised of a stiff material, for example plastic, wood, or metal. Referring to FIG. 9, the tongue 702 comprises a portion 703 proximate to one end of the tongue 702 that is thicker than the remainder of the tongue 702. The tongue 702 couples to the plate 701 at the portion 703, such that a gap 704 exists between the plate 701 and the remainder of the tongue 702. The plate 701 comprises one or more holes 103 through which one or more screws 104 (see FIG. 1) may traverse to couple the bracket 102A to the wedge 101. The plate 701 is illustrated with four holes 103, however, any number of holes may be used. Not all of the holes 103 need to be used to couple a particular bracket 102A-102B to the wedge 101.

Figure 10:
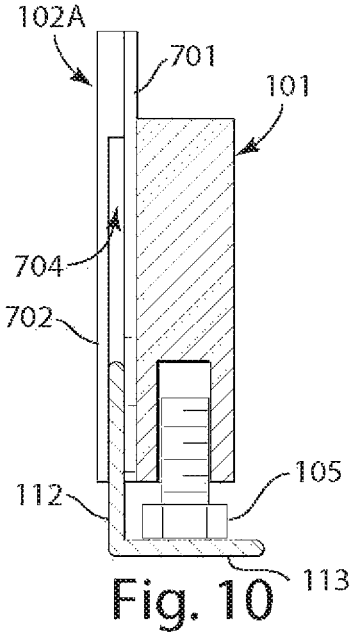
FIG. 10 illustrates a cross-sectional view of the first riser assembly as detachably coupled to the first metal rail of the metal bed frame according to the first embodiment of the present invention.
Figure 11:
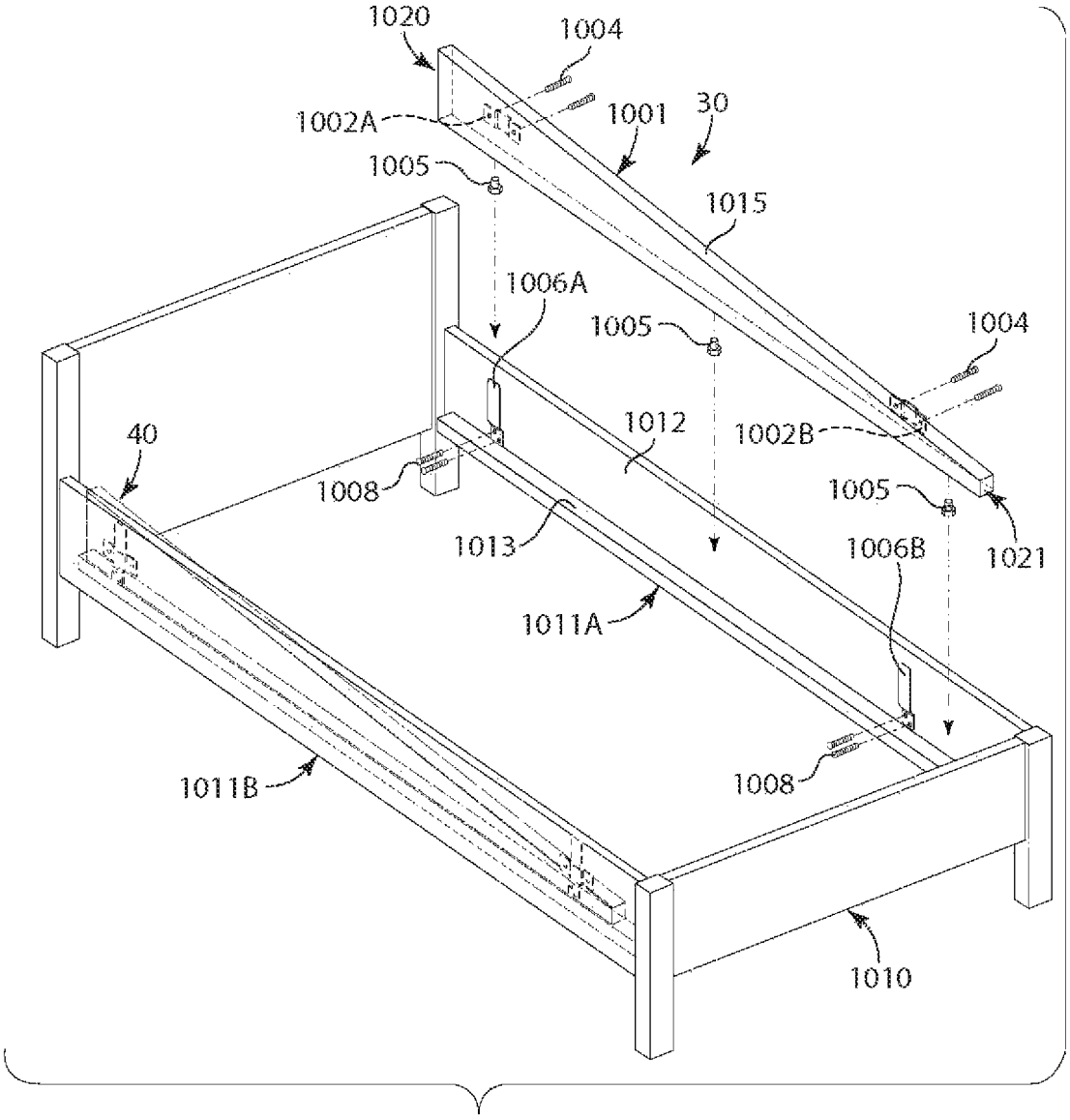
FIG. 11 illustrates a perspective the second embodiment of adjustable bed frame rail riser assemblies according to the present invention, as detachably coupled to a wooden bed frame.
Figure 12:
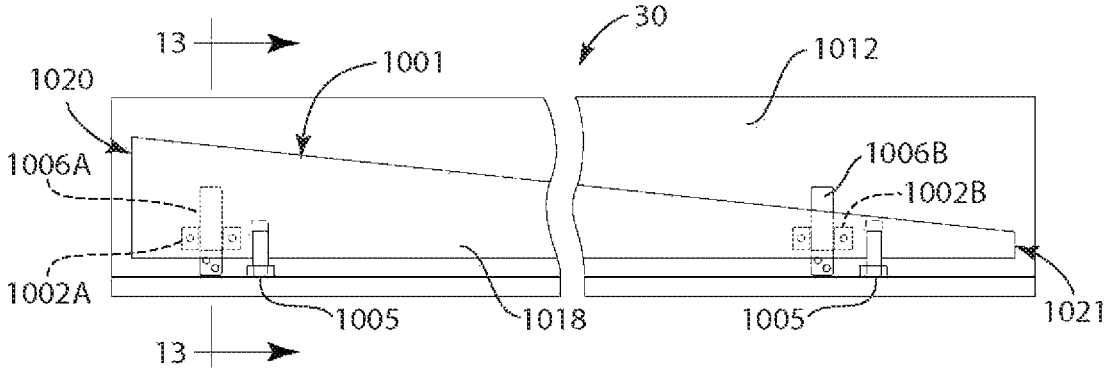
FIG. 12 illustrates a front view of third riser assembly, as detachably coupled to a first wooden rail of the wooden bed frame, according to the second embodiment of the present invention.

FIG. 10 illustrates a cross-sectional view of the first riser assembly 10 as detachably coupled to the first metal rail 111A of the metal bed frame 110 according to the first embodiment of the present invention. The cross-sectional view corresponds to the directional arrows illustrated in FIG. 2. When the first riser assembly 10 is detachably coupled to the first metal rail 111A, the bracket 102A engages the vertical wall 112 of the first metal rail 111A, such that a portion of the vertical wall 112 resides within the gap 704 between the plate 701 and the tongue 702. The adjustable feet 105 rests or the horizontal wall 113 of the first rail 111A. The other brackets 102B each comprise the same construction as the bracket 102A and engages the metal rails 111A-111B of the bed frame 110 in the same manner FIGS. 11-17 illustrate a second embodiment of adjustable bed frame rail riser assemblies according to the present invention. FIG. 11 illustrates a perspective of the second embodiment of adjustable bed frame rail riser assemblies according to the present invention, as detachably coupled to a wooden bed frame. The second embodiment comprises a third riser assembly 30 that can be detachably coupled to a first wooden rail 1011A of a wooden bed frame 1010 and a fourth riser assembly 40 that can be detachably coupled to a second wooden rail 1011B of the wooden bed frame 1010. The wooden bed frame 1010 is shown for illustrative purposes only and not to be construed as part of the embodiments of the present invention. FIG. 12 illustrates a front view of the third riser assembly 30, as detachably coupled to the first wooden rail 1011A, according to the second embodiment of the present invention.

Referring to FIGS. 11-12, the third riser assembly 30 comprises a wedge 1001 with a top surface 1015 and a bottom surface (hidden) opposite the top surface 1015 a first side 1017 (see FIG. 13) and a second side 1018 opposite first side 1017, one or more brackets 1002A-1002B coupled to the first side 1017 of the wedge 1001, one or more plates 1006A-1006B that can be coupled to the first wooden rail 1011A, one or more screws 1004, and one or more adjustable feet 1005 coupled to the bottom surface of the wedge 1001. The wedge 1001 comprises a tall end 1020 and a short end 1021, creating a slope at the top surface 1015 of the wedge 1001. The one or more plates 1006A-1006B can be coupled to a vertical wall 1012 of the first wooden rail 1011A. The one or plates 1006A-1006B are provided as installable parts to a user, and the user couples the one or more plates 1006A-1006B of the first wooden rail 1011A. When detachably coupled to the first wooden rail 1011A, the one or more brackets 1002A-1002B are detachably coupled to the one or more plates 1006A-1006B, and the adjustable feet 1005 rests on a horizontal wall 1013 of the first wooden rail 1011A. The positions and number of the brackets 1002A-1002B may be selected as a design choice, such as to accomplish the desired stability of the third wedge assembly 30 when installed. The positions of the plates 1006A-1006B correspond to the positions of the brackets 1002A-1002B. In this exemplary embodiment, the brackets 1002A-1002B are coupled to the wedge 1001 using one or more screws 1004 traversing through one or more holes 1003 in the brackets 1002A-1002B (see FIGS. 16-17), and the plates 1006A-1006B are coupled to the vertical wall 1012 of the first wooden rail 1011A using screws 1008, however, other coupling mechanisms may be used. In this exemplary embodiment, one or more screws are used adjustable feet 1005, where the length of each screw that protrudes beyond the bottom surface of the wedge 1001 may be independently adjusted to affect the angle of the slope at the top surface 1015 of the wedge 1001. Mechanisms other than screws may be used as well. The fourth riser assembly 40 comprises the same construction as the third riser assembly 30 except the brackets 1002A-1002B are coupled to the second side 1018 of the wedge 1001.

With the third and fourth riser assemblies 30, 40 detachably coupled to the first and second wooden rails 1011A-1011B of the wooden bed frame 1010, a mattress or box spring may be placed on the top surfaces 1015 of the wedges 1001. The slopes at the top surface 1015 of the wedges 1001 cause the mattress or box spring to rest at an incline or decline, with the tall ends 1020 positioned at the head or the feet of a user.

Figure 13:
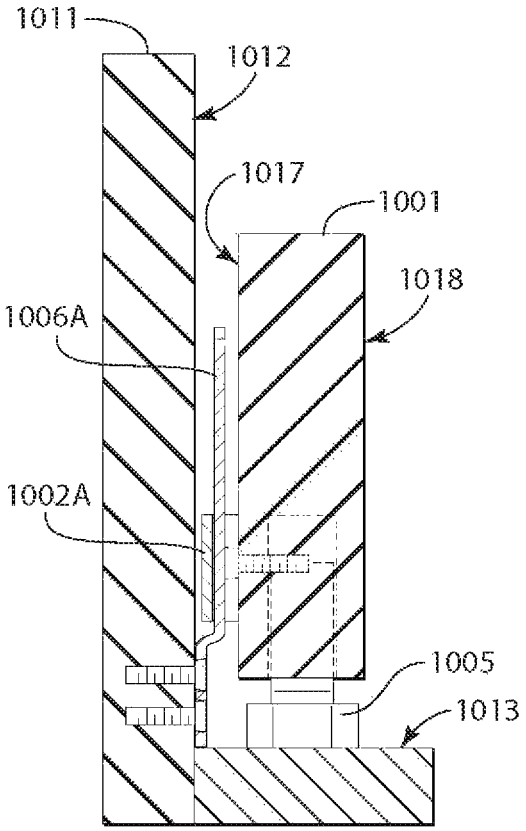
FIG. 13 illustrates a cross-sectional view of the third riser assembly as detachably coupled to the first wooden of the wooden bed frame according to the second embodiment of the present invention.

FIG. 13 illustrates a cross-sectional view of the third riser assembly 30 as detachably coupled to the first wooden rail 1011A of the wooden bed frame 1010 according to the second embodiment of the present invention. The cross-sectional view corresponds to directional arrow illustrated in FIG. 12. When the third riser assembly 30 is detachably coupled to the first wooden rail 1011A, the bracket 1002A coupled to the wedge 1001 engages the plate 1006A coupled to the vertical wall 1012 of the first wooden rail 1011A, and the adjustable feet 1005 rests on the horizontal wall 1013 of the first wooden rail 1011A. The fourth riser assembly 40 engages the second wooden rail 1011B of the wooden bed frame 1010 in the same manner.

Figure 14:
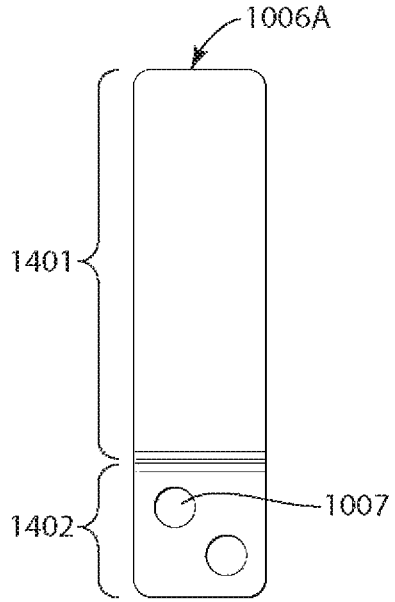
FIGS. 14-15 illustration front and side views, respectively, of a plate of the third riser assembly according to the second embodiment of the present invention.
Figure 15:
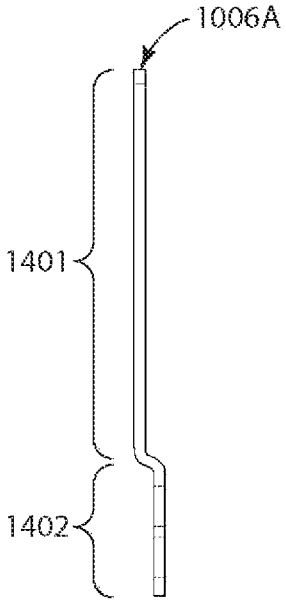

FIGS. 14-15 illustrate front and side views respectively, of a plate 1006A of the third riser assembly 30 according to the second embodiment of the present invention. The plate 1006A comprises a tongue portion 1401 and a coupling portion 1402, with a bend between the tongue 1401 and coupling 1402 portions. The coupling portion 1402 comprises one or more holes 1007 through which one or more screws 1008 (see FIG. 11) may traverse to couple the plate 1006A to the vertical wall 1012 of the first wooden rail 1011A. The plate 1006A is coupled to the vertical wall 1012 such that the tongue portion 1401 angles away from the vertical wall 1012, creating a gap between the tongue portion 1401 and the vertical wall 1012 (see FIG. 13). The other plates 1006B comprise the same construction as the plate 1006A.

Figure 16:
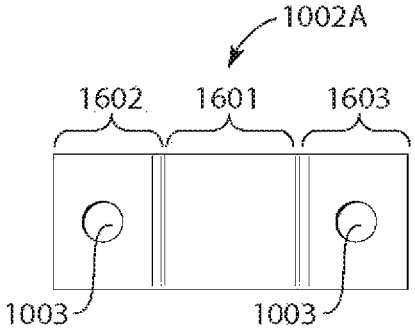
FIGS. 16-17 illustrate front and top views, respectively, of a bracket in the third riser assembly according to the second embodiment of the present invention.
Figure 17:
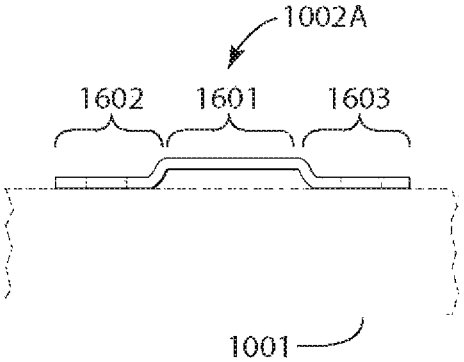

FIGS. 16-17 illustrate front and top views, respectively, of a bracket 1002A in the third riser assembly 30 according to the second embodiment of the present invention. In this embodiment, the bracket 1002A comprises a U-bracket with a first coupling portion 1602, a second coupling portion 1603, and a pocket portion 1601 between the coupling portions 1602-1603. Bends exist between the first coupling portion 1602 and the pocket portion 1601, and between the second coupling portion 1603 and the pocket portion 1601, such that a pocket exists between the pocket portion 1601 and the wedge 1001 when the bracket 1002A is coupled to the wedge 1001. The other brackets 1002B comprise the same construction as the bracket 1002A.

Referring to FIGS. 13 and 16-17, when detachably coupled to the first wooden rail 1011A, the tongue portion 1401 of the plate 1006A traverses through the pocket between the pocket portion 1601 of the U-bracket 1002A and the wedge 1001. The adjustable feet 1005 rest on the horizontal wall 1013 of the first wooden rail 1011A.

Figure 18:
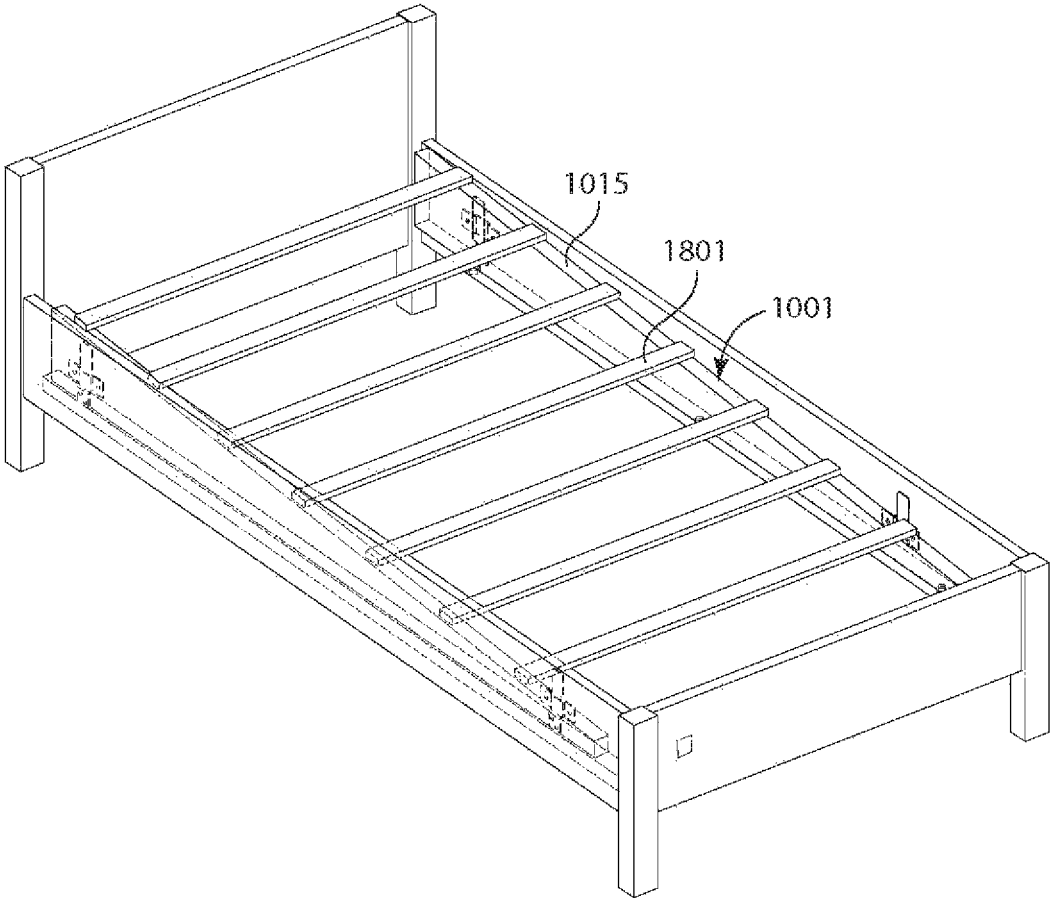
FIG. 18 illustrates a plurality of slats that may optionally be used with the first or second embodiments of the adjustable bed frame rail riser assemblies according to the present invention.

FIG. 18 illustrates a plurality of slats that may optionally be used with the first or second embodiments of the adjustable bed frame rail riser assemblies according to the present invention. Some bed frames include a plurality of slats 1801 to provide additional support for the mattress or box spring. In these instances, the third and fourth riser assemblies 30, 40 may be incorporated with the plurality of slats 1801 of the bed frame by coupling the slats 1801 to the top surfaces 1015 of the wedges 1001 of the first and second riser assemblies 30, 40. Similarly, the first and second riser assemblies 10, 20 may be incorporated with the plurality of slats 1801 by coupling the slats 1801 to the top surfaces 115 of the wedges 101 of the first and second riser assemblies 10, 20.

Embodiments of adjustable bed frame rail riser assemblies have been disclosed. The riser assemblies may be detachably coupled to standard metal or wooden bed frames and need not be permanent fixtures of the bed frames. The riser assemblies of the present invention do not require levers, arms, or electrical parts. The riser assemblies can further be coupled to standard metal or wooden bed frames, without requiring specially designed beds or bed frames.

Although the present invention has been described in accordance with embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. Bed frame rail riser assemblies, comprising:

a first riser assembly, comprising:

a first wedge with a first top surface, a first bottom surface opposite the first top surface, a first side of the first wedge, a second side of the first wedge opposite the first side of the first wedge, a first tall end, and a first short end, wherein the first tall end and the first short end create a first slope at the first top surface of the first wedge;

one or more first brackets coupled to the first side of the first wedge, each first bracket comprising:

a first coupling portion of the first bracket;

a second coupling portion of the first bracket; and a pocket portion of the first bracket between the first coupling portion and the second coupling portion of the first bracket, wherein a first pocket exists between the pocket portion of the first bracket and the first wedge; and one or more first plates, each first plate comprising:

a first tongue portion of the first plate;

a first coupling portion of the first plate; and a first bend between the first tongue portion and the first coupling portion of the first plate, wherein when installed on a first rail of a bed frame, the first coupling portion of the first plate is coupled to a first vertical wall of the first bed rail such that the first tongue portion of the first plate bends away from the first vertical wall, wherein when the first riser assembly is detachably coupled to the first rail of the bed frame, the first tongue of the first plate resides within the pocket portion of the first bracket; and a second riser assembly, comprising:

a second wedge with a second top surface, a second bottom surface opposite the second top surface, a first side of the second wedge, a second side of the second wedge opposite the first side of the second wedge, a second tall end, and a second short end, wherein the second tall end and the second short end create a second slope at the second top surface of the second wedge;

one or more second brackets coupled to the second side of the second wedge, each second bracket comprising:

a first coupling portion of the second bracket;

a second coupling portion of the second bracket; and a pocket portion of the second bracket between the first coupling portion and the second coupling portion of the second bracket, wherein a second pocket exists between the pocket portion of the second bracket and the second wedge; and one or more second plates, each second plate comprising:

a second tongue portion of the second plate;

a second coupling portion of the second plate; and a second bend between the second tongue portion and the second coupling portion of the second plate, wherein when installed on second rail of the bed frame, the second coupling portion of the second plate is coupled to a second vertical wall of the second bed rail such that the second tongue portion of the second plate bends away from the second vertical wall, wherein when the second riser assembly is detachably coupled to the second rail of the bed frame, the second tongue of the second plate resides within the pocket portion of the second bracket.

2. The assemblies of claim 1, wherein the first riser assembly further comprises one or more first adjustable feet coupled to the first bottom surface of the first wedge, wherein a length of each first adjustable feet protruding beyond the first bottom surface of the first wedge is independently adjustable to affect an angle of the first slope at the first top surface of the first wedge, wherein the second riser assembly further comprises one or more second adjustable feet coupled to the second bottom surface of the second wedge, wherein a length of each second adjustable feet protruding beyond the second bottom surface of the second wedge is independently adjustable to affect an angle of the second slope at the second top surface of the second wedge.

3. The assemblies of claim 2, wherein when the first riser assembly is detachably coupled to first rail of the bed frame, the one or more first adjustable feet rests on a first horizontal wall of the first rail, wherein when the second riser assembly is detachably coupled to the second rail of the bed frame, the one or more second adjustable feet rests on a second horizontal wall of the second rail.

4. The assemblies of claim 1, further comprising one or more slats coupled to the first wedge and the second wedge.

* * * * *